US005427281A

United States Patent [19]

Query et al.

[11] Patent Number: 5,427,281

[45] Date of Patent: Jun. 27, 1995

[54] REMOTE, METERED ACTUATOR FOR DISPENSING AEROSOL MATERIALS

[76] Inventors: O. Grady Query, 1020 W. Ashley Ave., Folly Beach, S.C. 29439; Grady W. Query, 1725 Matthews/Mint Hill Rd., Matthews, N.C. 28105

[21] Appl. No.: 167,150

[22] Filed: Dec. 16, 1993

[51] Int. Cl.[6] ..... B65D 83/14

[52] U.S. Cl. ..... 222/399; 222/394; 222/402.1

[58] Field of Search ..... 222/394, 399, 402.1

[56] References Cited

U.S. PATENT DOCUMENTS 3,013,699 12/1961 Meuwly ..... 222/394 X
3,804,299 4/1974 Kain ..... 222/394 X
4,201,319 5/1980 Andera et al. ..... 222/399 X
4,887,651 12/1989 Santiago ..... 222/399 X
5,174,343 12/1992 Rood ..... 222/399 X

FOREIGN PATENT DOCUMENTS 151635 3/1932 Switzerland ..... 222/399

*Primary Examiner*—Andres Kashnikow
*Assistant Examiner*—Joseph A. Kaufman
*Attorney, Agent, or Firm*—B. Craig Killough

[57] ABSTRACT

A metering device for aerosol containers which is attached to an aerosol container and which controls the amount of aerosol material which is dispensed by the aerosol container. Aerosol material is received into a reservoir which is remotely located from the aerosol container. A metered actuator dispenses a predetermined amount or dose of aerosol material.

8 Claims, 4 Drawing Sheets

REMOTE, METERED ACTUATOR FOR DISPENSING AEROSOL MATERIALS

FIELD OF THE INVENTION

This invention relates generally to aerosols and aerosol containers, and is specifically directed to a remote, metered actuator which may be used to deliver aerosol materials from an aerosol container to remote locations in metered doses.

BACKGROUND OF THE INVENTION

Many materials are delivered by aerosol means. Paints, cleaners, chemical treatment products, and pest control materials are just a few of the materials which are delivered by aerosol means. Aerosols are most commonly characterized by a liquid material propelled by a gas, most typically chlorofluorocarbons and hydrocarbons.

Many of the materials delivered by aerosol means are toxic or environmentally hazardous. The propellants used may be environmentally harmful. Accordingly, it is desirable to efficiently and effectively deliver the aerosol material, releasing a minimum of the material into the environment.

Aerosol containers range in size from small containers in which consumer goods such as deodorants are placed, to very large containers which cannot be easily lifted. With containers having a capacity of more than a liter, it is difficult to direct the aerosol material as desired due to the size of the container, especially where the point of application of the material is not easily accessible. Commerical operators routinely carry aerosol containers with five gallons or more of aerosol composition contained therein. Remote actuators have been used to allow the material to be directed as desired, since the size of the container does not allow the spray valve, actuator and nozzle to be applied directly to the container.

Metering of such remote actuators is needed. Metering prevents an excess of material, which may be environmentally hazardous or otherwise undesirable, from being released into the atmosphere and environment.

While metered spray valves are available, these valves have not been typically used with remote actuators due to problems associated with, among other things, bleeding and priming of the actuator.

SUMMARY OF THE PRESENT INVENTION

The present invention is a remote metered actuator which may be connected to an aerosol container. The device is relatively small, and may be easily held in a user's hand so as to be easily controllable. The aerosol material may be directed by the operator into difficult to reach areas to, for example, treat cracks and crevices in pest control operations.

The present invention provides a reservoir which may be held in an operator's hand. The reservoir has an inlet means and an outlet means. A valve is connected to the inlet means. The valve is then connected to an aerosol container by, for example, a length of tubing or hose. The valve has a tube extending upwardly into the reservoir and opening into an upper portion of the reservoir.

A metered actuator is connected to an outlet of the reservoir, which is located in an upper portion of the reservoir. The metered actuator has a tube extending into the reservoir, and into a lower portion of the reservoir. In use, the remote metered actuator is connected to the aerosol container. The valve is open to bleed air from the reservoir, and the reservoir fills with aerosol material. The metered actuator is then depressed to actuate the spray valve and release the aerosol material in a metered dose.

DESCRIPTION OF THE PREFERRED EMBODIMENT

Figure 1:
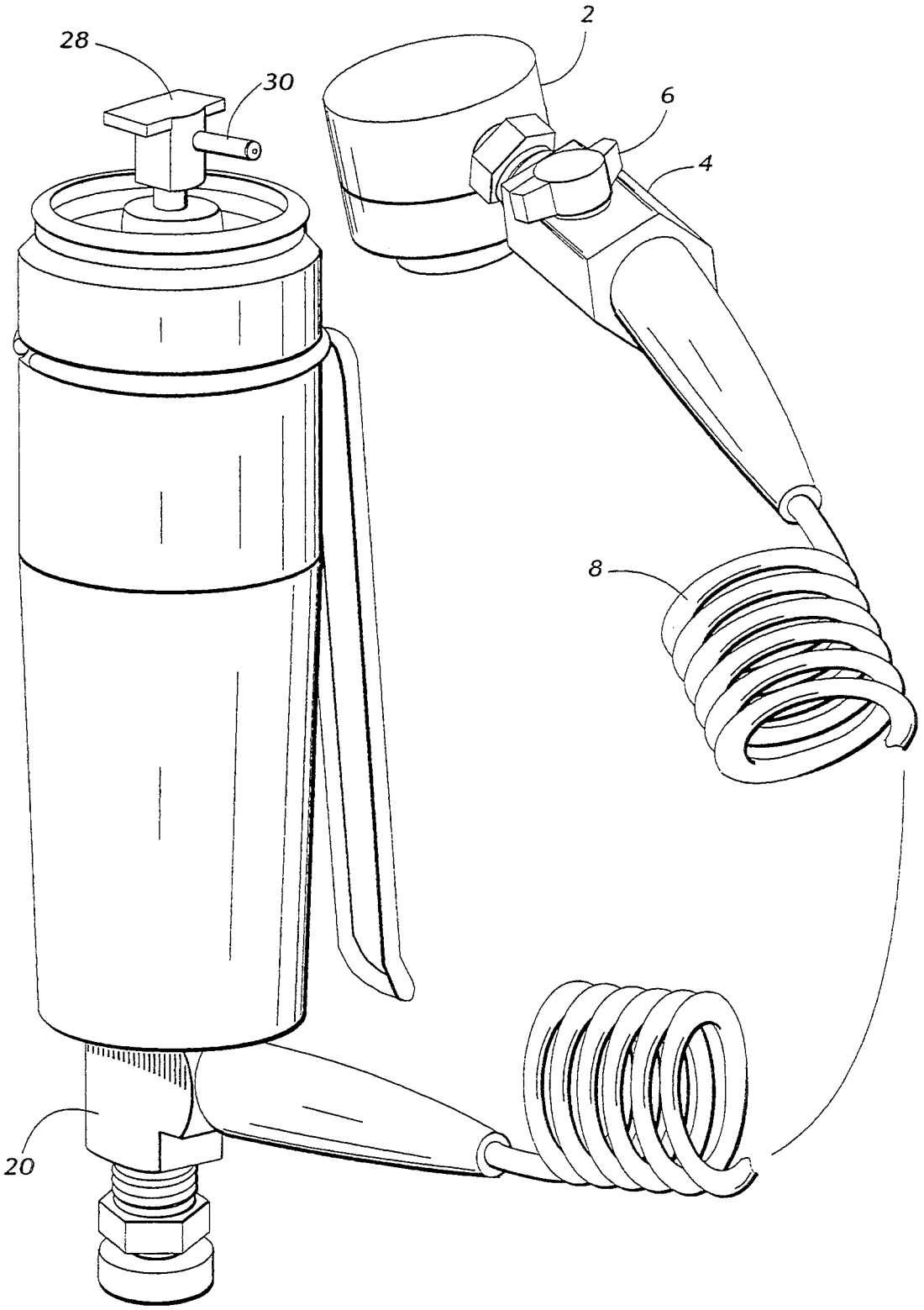
FIG. 1 is a perspective view of the device, showing a connection valve for connection to an aerosol container, which is not shown.

Referring now to the drawing figures, FIG. 1 shows the device as it is connected to an aerosol container. An actuator 2 is connected to an aerosol container. This actuator may have valve means 4, with an actuator switch 6 for the valve means provided. A tube or hose 8 connects the aerosol container and actuator to the reservoir. This hose or two may be coiled, if desired, for convenience.

Figure 2:
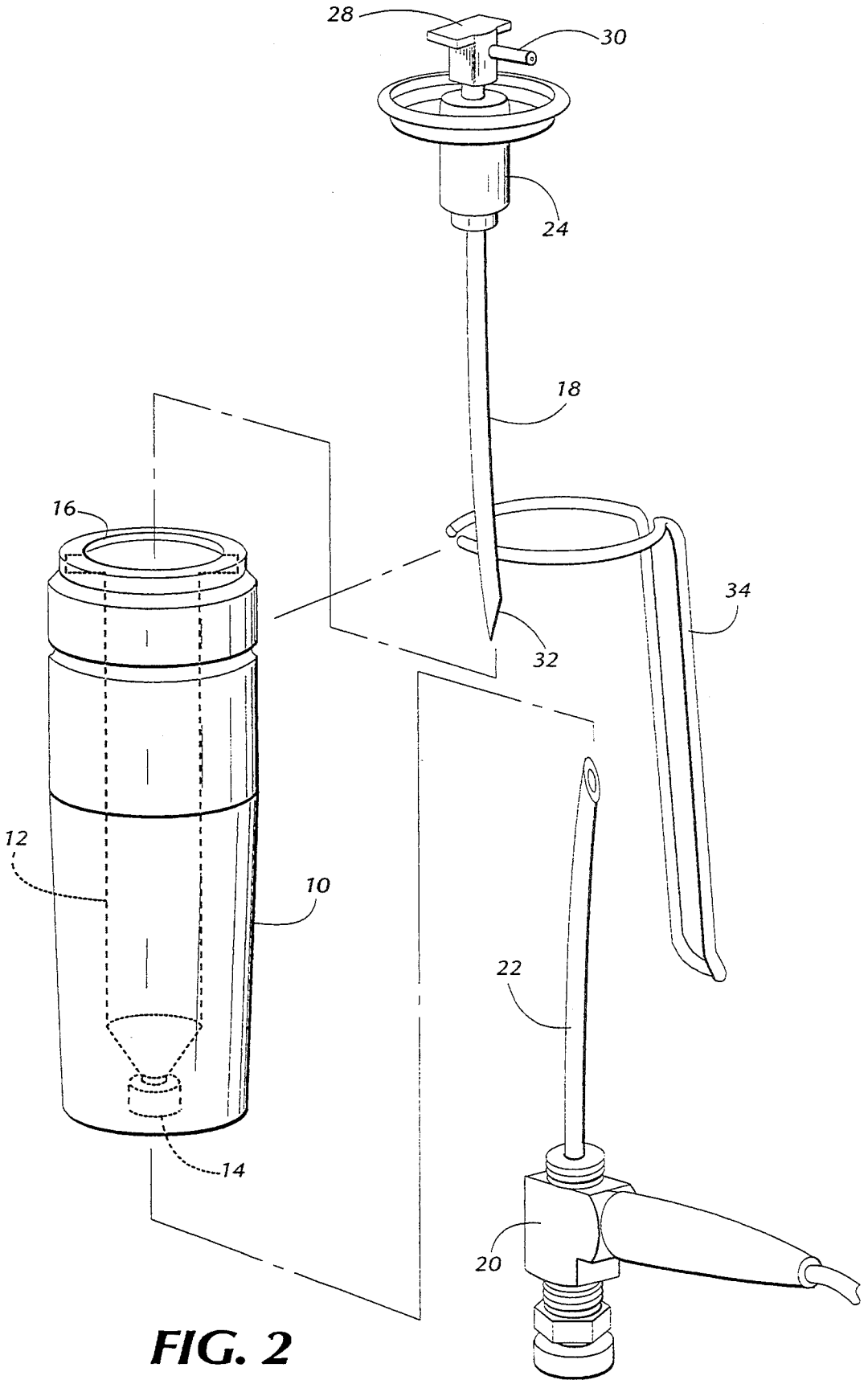
FIG. 2 is an exploded view of the device, showing the interior of the reservoir.
Figure 3:
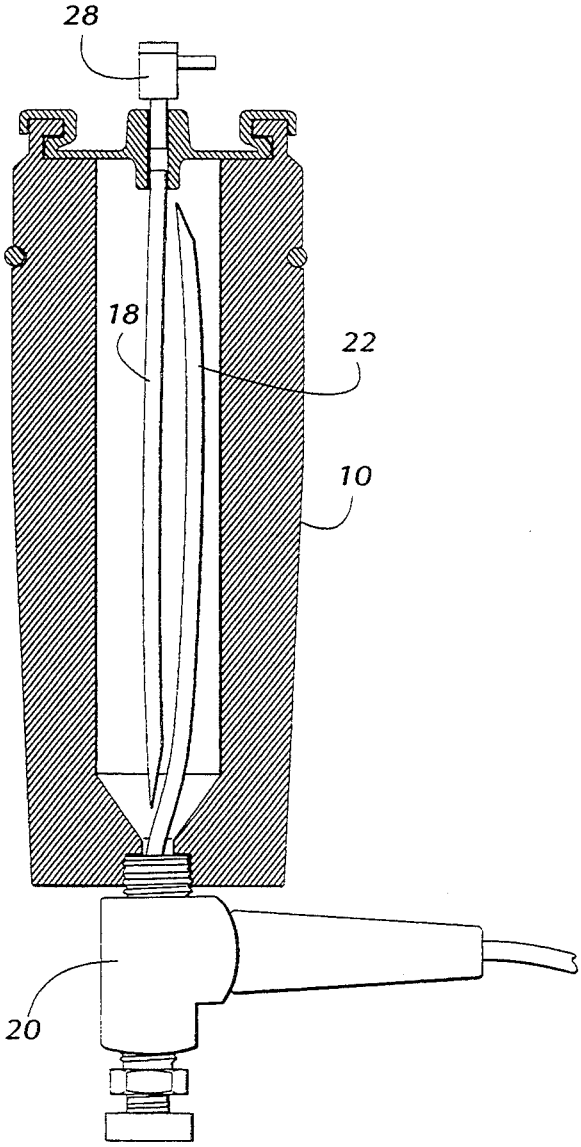
FIG. 3 is a side, sectioned view of the reservoir, showing the metering actuator and valve connected to the reservoir.
Figure 4:
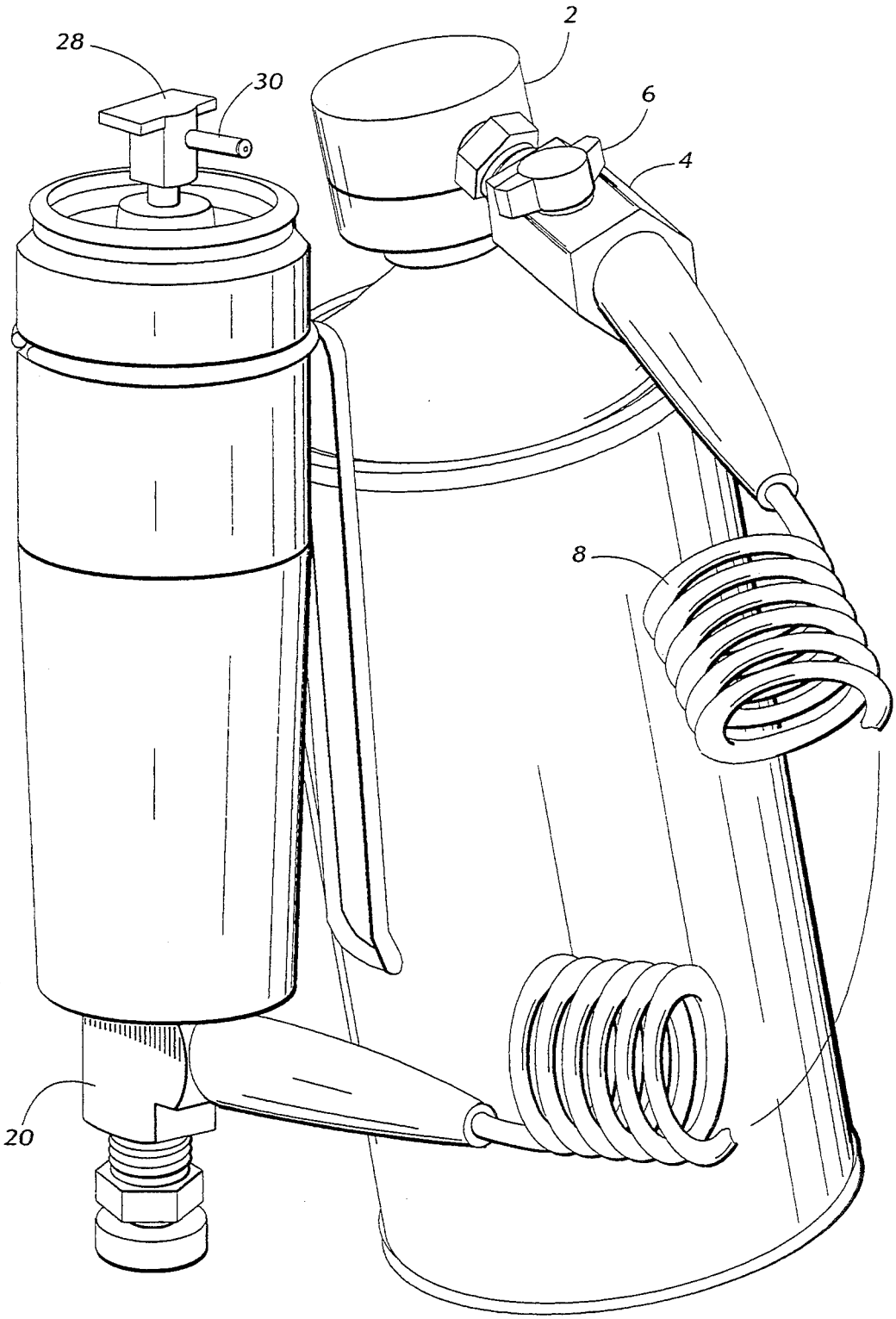
FIG. 4 shows a perspective view of the device with the aerosol container attached.

As shown in FIG. 2, the reservoir 10 has a bottom inlet 14 and top outlet 16. The interior of the reservoir is a void 12 into which material is received from the aerosol container. The size of the interior void is determined according to the dose to be metered by the metering actuator. The interior void receives the aerosol material, which is comprised of liquid and gas in most applications. Accordingly, it is preferred that the bottom of the void is tapered to direct all of the liquid material to the opening of the dip tube 18 from the metering actuator. The reservoir is of an exterior diameter which is convenient for holding in the hand of the operator.

A valve 20 is attached to the reservoir at the inlet. The attachment means of the value to the reservoir may be threaded. The valve has a tube 22 extending from the valve into the void of the reservoir. The tube extends into, and opens into, an upper portion of the void. When the valve is opened, material from the reservoir, which is typically air or propellant gas, is bled to the outside of the device. When valve 20 is closed, material flows from the aeorsol container through the tubing 8, the valve 20 and the tube 22 into the void 12 of the reservoir, where the aerosol combination is contained.

A metering actuator 24 is attached to the outlet 16 of the reservoir. The metering actuator may be attached to the outlet by crimping, or by threaded means, but the attachment at the metering actuators may be done in any fashion which will render the connection air tight and liquid tight under the normal operating pressures of the reservoir.

The metering actuator 24 comprises a spray valve and an actuator button 28 comprising, in this embodiment, a nozzle 30. Metering actuator 24 will deliver a predetermined amount of aerosol material according to the construction of the metering valve once the actuator button is depressed.

Dip tube 18 extends from the metering actuator into a lower portion of the reservoir void, to pick up liquid which falls to the bottom of the reservoir void. The liquid material is forced out of the reservoir by propellant gas through the dip tube 18 and the metering actuator, and out of the nozzle, in an aerosol form.

In use, an aerosol container is filled with a material to be delivered, and a propellant. The material is any material normally delivered, applied, or distributed by aerosol means. The aerosol propellant may be any pressurizing gas normally used in aerosol applications, including carbon dioxide, chlorofluorocarbons and hydrocarbons. The proportions of liquid and gas will vary according to the material to be delivered and the propellant used. Typically, the combination will comprise approximately 20% to 50% liquid and approximately 50% to 80% propellant gas.

The actuator 2 is placed on the aerosol container. The actuator 2 simply performs the function of a conduit, through which the aerosol passes from the aerosol container. Accordingly, this actuator may simply engage the aerosol container, or it may have some actuation structure, such as a means for depressing a release valve which is built into the aerosol container. The actuator may or may not have, or be connected to, a valve 4.

The propellant under pressure attempts to escape the aerosol container through the actuator. As it escapes, it forces the liquid material with it. This aerosol combination of gas and liquid is forced through the tubing and into the reservoir 10.

Initially, as the device is connected to an aerosol container, air is present in the hose and the reservoir. Accordingly, before the device can be used by depressing the actuator button 28 to release material through the metering actuator and the nozzle, air must be bled from the device. Holding the reservoir in the upright position, valve 20 is opened. The aerosol combination attempts to escape to the area of lower pressure, travelling through valve 4 and filling tubing 8 or hose. The aerosol mixtures also begins to force its way through the tube and begins to fill the void within the reservoir 12. Air is therefore purged through valve 20.

Once air has been purged from the system, the reservoir fills with aerosol mixture. The device is used by depressing the actuator button 28 to release material through the nozzle. As material is released through metering valve 24, the aerosol mixture continues to be supplied from the aerosol container, entering the reservoir through the tube. The use of the tube allows the aerosol material to enter the void of the reservoir in the upper portion where the lighter gas propellent is present within the reservoir, rather than where liquid is present, to provide a free flow of material into the void of the reservoir. Since the aerosol mixture will typically be 20–50% liquid, by weight, the upper portion of the reservoir will have gas present, and the aerosol mixture enters the void of the reservoir in this upper portion where propellant gas is present.

The propellant gas, which is present within the void of the reservoir, forces liquid out through the dip tube 22 and forms on aerosol material of liquid and gas. This aerosol mixture which is forced out through the dip tube, the metering actuator and the nozzle, deliver the aerosol as desired. The opening 32 to the dip tube is positioned near the bottom of the void in the reservoir to pick up as much liquid as possible. Likewise, the bottom of the reservoir, in the preferred embodiment, is tapered to focus the liquid to a point to pick up as much liquid as possible through the opening of the dip tube. A holster 34 may be provided to hold the reservoir on the operator's side when the device is not in use.

The metering actuator may be selected to meter a predetermined amount of aerosol material. Present within the reservoir will be sufficient aerosol material to deliver at least one dose of the material.

The present invention provides a metering actuator which will deliver a predetermined amount of aerosol material. The device allows material to be delivered to a location which is remote from the aerosol container and is small enough and maneuverable enough to allow aerosol material to be delivered with precision in areas where movement or access is restricted. Other actuator button or nozzle configurations may be used to further aid in delivering aerosol material to restricted or limited access areas.

What is claimed is:

1. A metered aerosol actuator for dispensing aerosol materials, comprising:

a. a reservoir having an inlet in a lower portion thereof, and an outlet in an upper portion thereof;

b. a valve connected to an aerosol container and connected to said inlet of said reservoir, said valve having a tube extending from said valve into an upper interior portion of said reservoir and opening into said interior portion of said reservoir; and c. a metering actuator connected to said outlet means of said reservoir, said metering actuator having a tube extending from said metering actuator into a lower interior portion of said reservoir and opening into said lower interior portion of said reservoir near a bottom of said reservoir.

2. A metered aerosol actuator for dispensing aerosol materials as described in claim 1, wherein said valve is connected to said aerosol container by means of filling tubing which is connected to an aerosol actuator which is in turn connected to said aerosol container.

3. A metered aerosol actuator for dispensing aerosol materials as described in claim 2, wherein said actuator which is connected to said aerosol container has a valve therein.

4. A metered aerosol actuator for dispensing aerosol materials as described in claim 1, wherein the interior of said reservoir is tapered in a lower portion thereof.

5. A metered aerosol actuator for dispensing aerosol materials as described in claim 2, wherein the interior of said reservoir is tapered in a lower portion thereof.

6. A metered aerosol actuator for dispensing aerosol materials as described in claim 3, wherein the interior of said reservoir is tapered in a lower portion thereof.

7. A metered aerosol actuator for dispensing aerosol materials, comprising:

a. a reservoir having an inlet located in a lower portion thereof which opens into an interior of said reservoir, and having an outlet in an upper portion thereof;

b. filling tubing communicating with said inlet which is located in said lower portion of said reservoir, into which is received an aerosol mixture, wherein said aerosol mixture is transported through said filling tubing and said inlet and into said reservoir;

c. an actuator which is connected to said outlet of said reservoir through which said aerosol mixture is discharged upon actuation of said actuator; and d. a tube communicating with and extending from said inlet in said lower portion of said reservoir to an upper interior portion of said reservoir, and opening into said upper portion of said reservoir.

8. A metered aerosol actuator for dispensing aerosol materials as described in claim 7, further comprising a bleeding and priming valve positioned adjacent to and communicating with said inlet of said reservoir, wherein said filling tubing communicates with said valve, and wherein said aerosol mixture is transported through said filling tubing, said valve and said inlet and into said reservoir.

* * * * *